US005328206A

United States Patent [19]

Scott

[11] Patent Number: 5,328,206

[45] Date of Patent: Jul. 12, 1994

[54] BOARD BOOK WITH EASILY-TURNED PAGES

[76] Inventor: Katherine J. Scott, 33 Whippoorwill Way, Belle Mead, N.J. 08502

[21] Appl. No.: 21,198

[22] Filed: Feb. 23, 1993

[51] Int. Cl.[5] ..... B42D 1/00

[52] U.S. Cl. ..... 281/38; 271/15.1; 271/DIG. 1

[58] Field of Search ..... 281/15.1, 38, 40, 42, 281/DIG. 1; 402/4, 79, 80 L; 283/36, 37, 38, 39

[56] References Cited

U.S. PATENT DOCUMENTS

| | | | |
|---|---|---|---|
| 283,383 | 8/1883 | Silvera . | |
| 306,318 | 10/1884 | Butler . | |
| 466,530 | 1/1892 | Trask | 283/39 |
| 511,339 | 12/1893 | Livesey . | |
| 648,476 | 5/1900 | Wiley . | |
| 945,765 | 1/1910 | Drake | 283/39 |
| 1,311,733 | 7/1919 | Wilmot . | |
| 1,404,541 | 1/1922 | Parsons . | |
| 3,719,161 | 2/1973 | Wegner | 281/DIG. 1 |

*Primary Examiner*—Mark Rosenbaum
*Assistant Examiner*—Willmon Fridie, Jr.
*Attorney, Agent, or Firm*—Woodbridge & Collins Mathews

[57] ABSTRACT

An improved stiff-paged board book uses spacing structures between adjacent leaves to form small gaps which provide convenient finger holds that facilitate turning of individual pages by young children. The gaps allow single pages to be turned easily irrespective of where they are grasped by a reader and reduce the tendency of pages to stick to one another. Spacing structures are formed by affixing a solid block to a leaf, by impressing a protrusion into the leaf, or by embedding magnets in the leaf with like polarizations facing adjacent pages.

10 Claims, 5 Drawing Sheets

BOARD BOOK WITH EASILY-TURNED PAGES

BACKGROUND OF THE INVENTION

1. Field of the Invention

This invention relates to stiff-paged board books with spacers between successive leaves to facilitate page turning by young children.

2. Description of the Related Art

It is widely recognized that young children lack the manual dexterity required to turn pages in standard books comprised of thin sheets of paper. For this reason, it is common practice to manufacture young children's books from relatively thick, rigid cardboard leaves. A typical example of such board books is *Big Bird's Color Game* (copyright © 1980 Children's Television Workshop, Western Publishing Company, Inc., Racine, Wisc. Library of Congress Catalog Card Number 79-67616) which has seven leaves each 0.045 inches thick. The practice of fabricating books from thick, stiff pages alleviates, but does not eliminate, children's difficulties in selecting, fingering, and turning individual pages. Pages stick together and children often turn several pages at once rather than one at a time.

A variety of prior art methods have been developed to facilitate page location and turning in books and indices. U.S. Pat. No. 511,339 describes a book composed of leaves each having a small portion cut out from the edge opposite the edge of the book binding. The cut-out regions become larger, in the direction parallel to the edge of the book binding, on successive leaves so that a small part of each leaf projects beyond all of the leaves beneath it. Alternately, the cut-out regions are of constant size and shape, but are displaced vertically on successive pages. Both constructions effectively create a small tab on each leaf which can be grasped by the reader without interference from leaves of the book beneath it. These approaches are effective only for readers capable of identifying the presence and purpose of the tab region of each leaf, and with sufficient manual dexterity and eye-hand coordination to grasp this small area of the leaf when turning the page. They do not reduce the probability of pages sticking together. Further, such designs incur increased manufacturing costs because each sheet must be cut differently.

U.S. Pat. No. 648,476 describes an index book whose leaves have rounded stubs projecting from the open book edge. Stubs on successive leaves are displaced along the length of the edge so that each leaf offers a small tab which can be labeled for identification and grasped without interference from underlying leaves. The stubs partially overlap on successive leaves to provide mechanical support that prevents their corners from being turned up. As in the patent cited previously, this design provides only a small tab area to be grasped, and requires a degree of manual dexterity and eye-hand coordination not developed in young children.

Of possible general relevance to the invention are U.S. Pat. Nos. 283,383; 306,318; 1,311,733; and 1,404,541. These describe methods to provide regions on selected leaves in conventional books, fan-folded books, and index books for indexical text to be printed, such as alphabetical or subject headings. This is accomplished by steadily increasing the leaf size on successive pages, or by cutting out segmental recesses in several leaves preceding the leaves upon which the indexical text is printed. Such configurations are designed primarily to facilitate the rapid visual location of a desired book section by ensuring that all indexical text printed on the leaves is visible simultaneously. They offer some improvement in the ease of grasping a desired page for readers with mature eye-hand coordination and reading ability, compared to standard books with leaves of constant size and shape.

A satisfactory solution to the difficulties experienced by young children turning pages in stiff-paged board books, which addresses their limited manual dexterity and eye-hand coordination, is not found in the prior art.

SUMMARY OF THE INVENTION

Briefly described, the invention comprises a set of spacing devices which are affixed or impressed onto, or embedded into, the leaves of a stiff-paged board book. The spacers create small gaps between successive leaves of the book, which render the pages capable of being more easily turned by young children with limited eye-hand coordination and manual dexterity. In addition, the spacers substantially decrease the contact area between adjacent leaves, which reduces the propensity of the leaves to stick to one another.

In one embodiment, spacers consist of thin blocks of cardboard or other material which can be permanently affixed to the book leaves with adhesive. Alternately, spacers can be formed by impressing indentations into the stiff book leaves, thereby forming protrusions on the opposite page. Finally, gaps between book leaves can be created by embedding magnets in adjacent leaves so that like magnetic polarizations (North-North or South-South) face one another and provide magnetic repulsion. The number of leaves requiring special manufacturing processing can be reduced, except in the case of magnetic spacers, by alternating leaves having spacers on both sides with leaves having no spacers.

These and other features of the invention will be more fully understood by reference to the following drawings.

DETAILED DESCRIPTION OF THE INVENTION

During the course of this description like numbers will be used to identify like elements according to the different views which illustrate the invention.

Figure 1A:
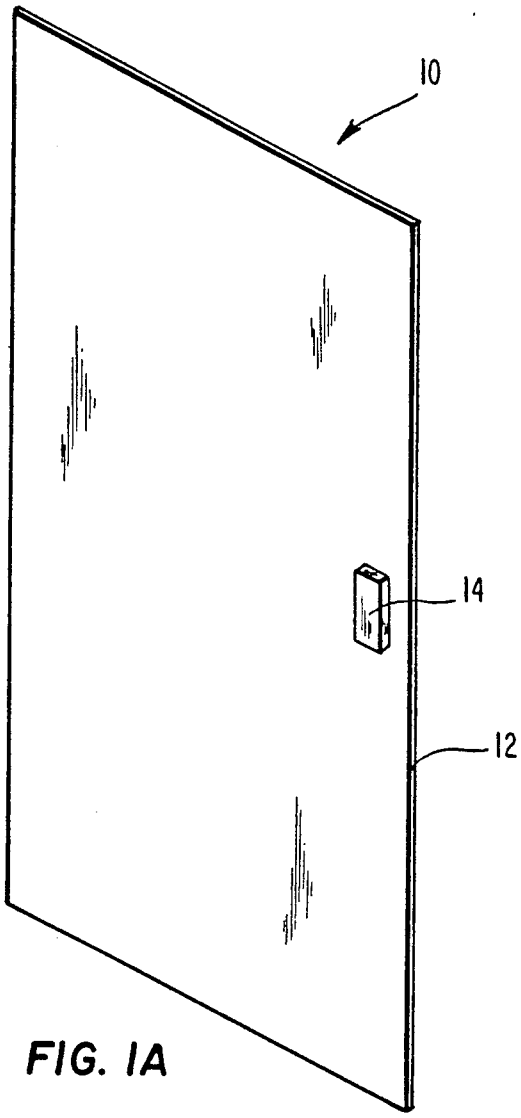
FIG. 1A is a perspective view of the preferred embodiment of the invention with a material spacer affixed to an individual page of a stiff-paged board book.

FIG. 1A illustrates the preferred embodiment of the invention 10 in which a spacer 14 is permanently affixed to the middle of a stiff cardboard leaf or page 12 of a board book near the edge opposite the binding. Spacer 14 is preferably fabricated from cardboard but other materials such as plastic could also be used. The preferred thickness of spacer 14 is between about 0.03 and 0.20 inch and most preferably approximately 0.06 inch, comparable to the thickness of leaves in standard board books, which range from 0.04–0.06 inch. A spacer thickness of less than 0.03 inch does not provide sufficient clearance between leaves to assist the reader in grasping a page, while a spacer thickness that exceeds approximately 0.20 inch makes the board book excessively thick and would strain the binding upon closing. The preferred dimensions of spacer 14 are 0.35 inch wide by 0.70 inch long. The shape and dimensions of spacer 14 are not critical, but it should be large enough to provide sufficient adhesion to the leaf to resist prying-off by the reader.

Since the sole function of the spacer 14 is to provide mechanical clearance between adjacent book leaves, there is considerable latitude in positioning the spacers on the leaves. The spacers 14 can be located at the open end of the leaf or at the top or bottom of the leaf. The preferred location is vertically centered, near the open edge opposite the binding, to provide a gap that is nearly constant in thickness along the length of the leaf. Board books which exceed approximately 9 inches in height, or which are fabricated from cardboard less rigid than that commonly used in such books, may require two spacers 14 to ensure that a gap of sufficient thickness is maintained along the entire length of the leaf, one positioned near the top of the leaf and one near the bottom. Positioning the spacers 14 along the top or bottom edge, closer to the binding, allows the desired clearance between pages to be realized with a thinner spacer, however this will increase the stress on the leaves and on the binding when the book is closed and compressed laterally, as occurs on a crowded bookshelf.

Figure 1B:
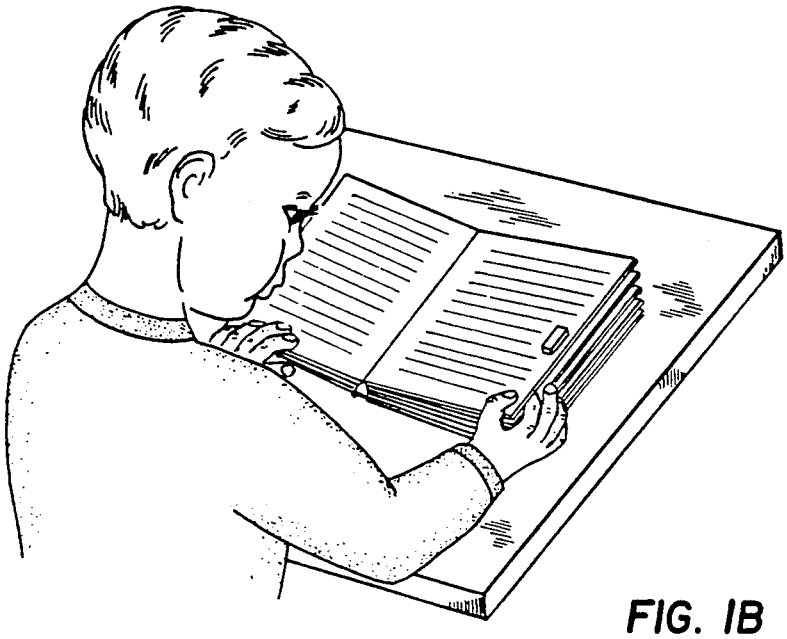
FIG. 1B illustrates a young child turning the pages of a board book with spacers between successive leaves.

FIG. 1B illustrates the use of invention 10 in a board book constructed from multiple leaves each having a spacer 14 to provide gaps between successive pages. The gaps extend along the full length of each leaf, and facilitate page-turning irrespective of where the reader grasps the page. Another problem encountered by young readers, the tendency of pages to stick to one another, is ameliorated because the only contact between successive pages occurs at the spacer itself and near the binding. The gaps further diminish the propensity of pages to stick together by providing air circulation between pages, which allows the juice, saliva, and other spilled or dribbled liquids to evaporate.

Vertically, the spacers 14 can be located at the same or at different positions on the page. Alternating leaves having spacers 14 on both sides with leaves having no spacers 14 will reduce the number of leaves which require extra manufacturing processing to affix or impress the spacers 14, except in the case of magnetic spacers discussed below.

Figure 2:
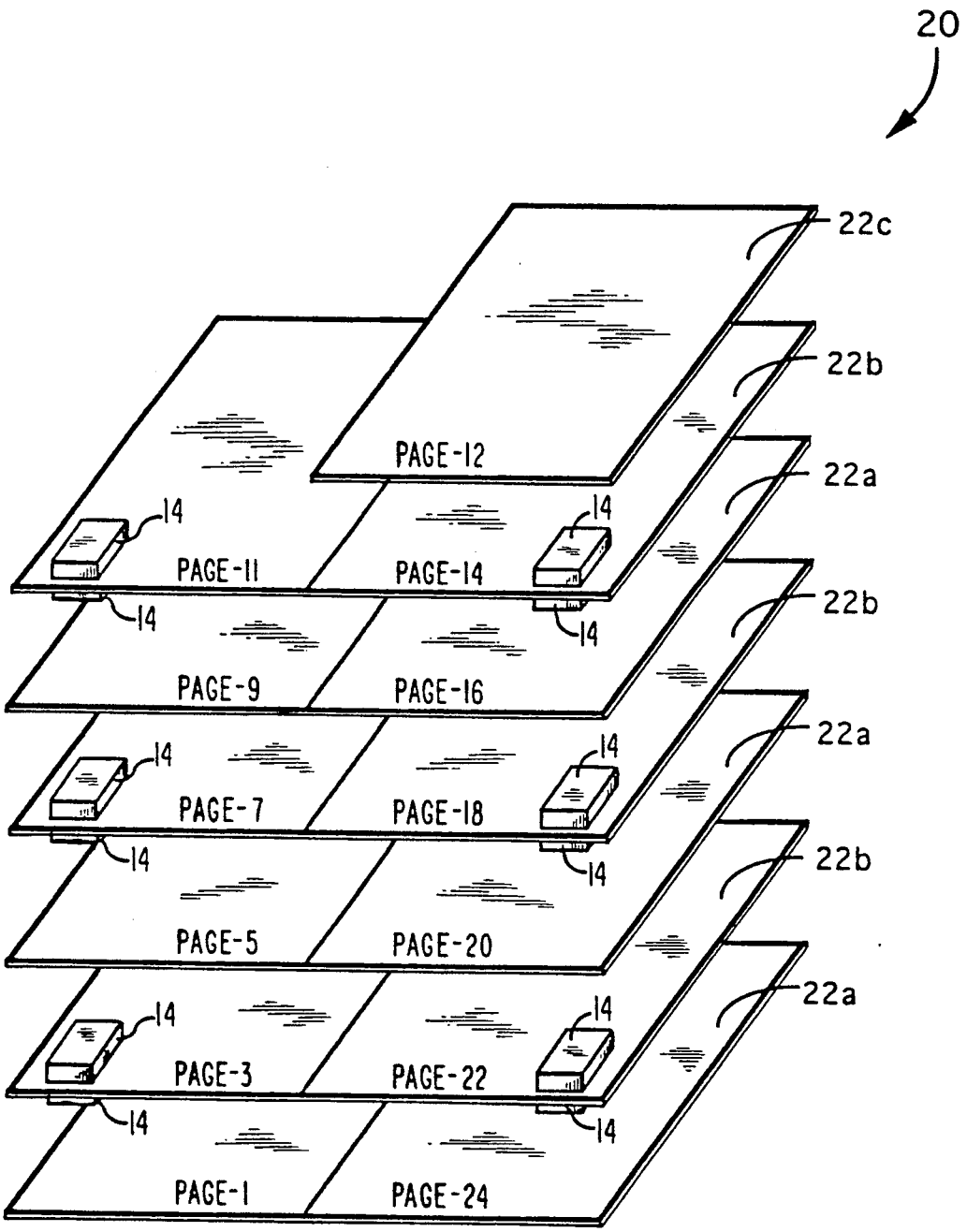
FIG. 2 is an exploded view of a board book with spacers on alternate pages only.

FIG. 2 shows an exploded view of an embodiment 20 which reduce the number of sheets requiring spacers 14 still further by interleaving cardboard leaves 22*a*, which have no spacers 14, with leaves 22*b*, which have four spacers 14. These sheets are folded at the book binding to form two leaves per sheet. For clarity of illustration the spacers 14 are shown positioned in the lower corner of the book leaves, but they could be located in the middle of the leaves equally well, as shown in FIG. 1. Minor adjustments to the interleaving sequence are required at the middle of the book to ensure that all leaves are separated by one and only one spacer 14. If, as shown in FIG. 2, the number of leaves in the book is odd, a half-sheet 22*c* is inserted at the top of the stack, which forms only a single leaf. Half-sheet 22*c* has no spacers on it if the underlying sheet is of type 22*b*, but it will have a spacer 14 on each of its two surfaces if the underlying sheet is of type 22*a*. If the number of leaves is even, it will be necessary to remove one of the upper-facing spacers 14 from the top sheet if it is of type 22*b*, or to add one upper-facing spacer 14 to the top sheet, if it is of type 22*a*.

Figure 3:
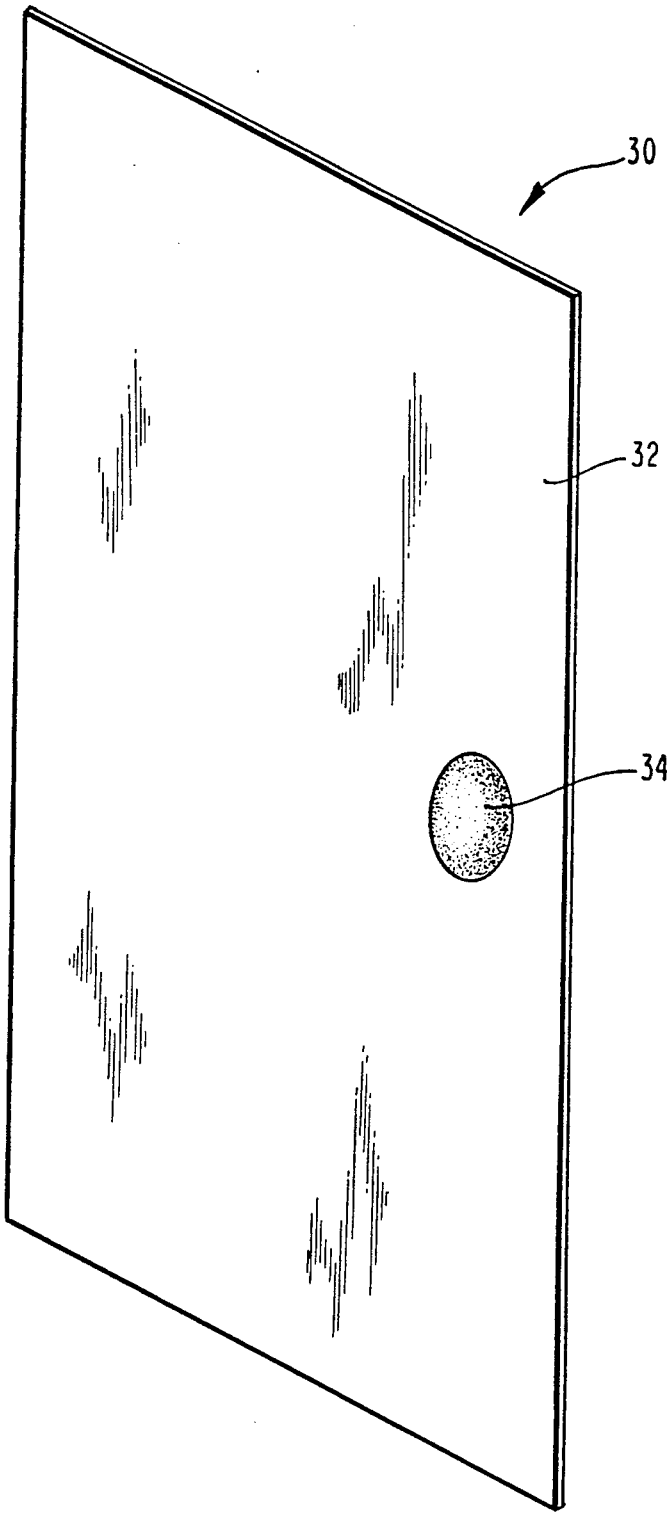
FIG. 3 is a perspective view of a spacer created by impressing a protrusion on a book leaf.
Figure 4:
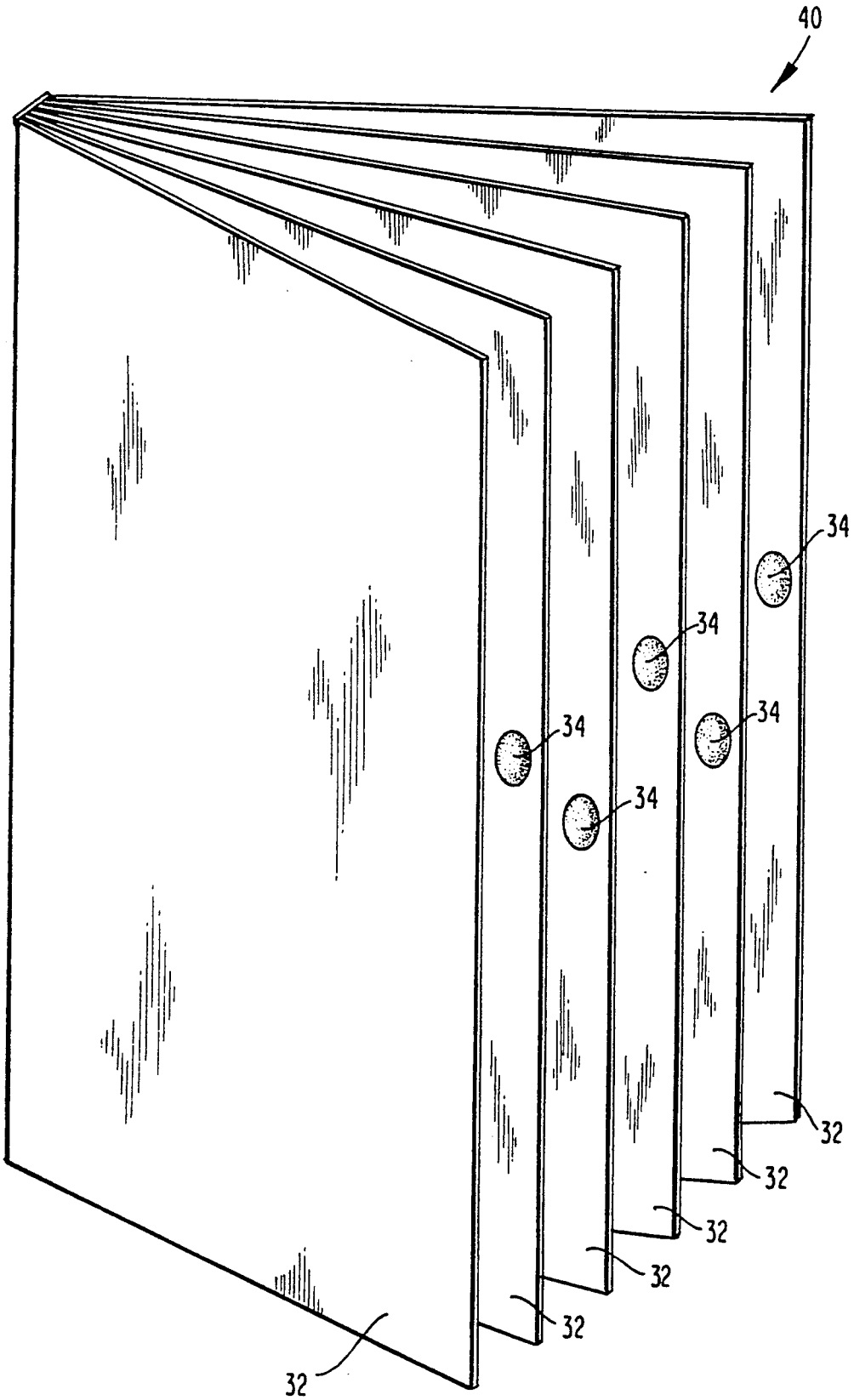
FIG. 4 is a perspective view of a board book with spacers formed by protrusions, whose positions are staggered on successive leaves.

FIG. 3 illustrates an alternate embodiment 30 of the invention, consisting of a cardboard leaf 32 with integral spacer 34 which is formed by impressing an indentation into the leaf 32 with a conventional stamping machine, thereby forming a protrusion spacer 34 on the other side. As shown in embodiment 40 in FIG. 4, the position of the spacers 34 is shifted or staggered on successive pages 32 to avoid nesting of the indentations and corresponding protrusions.

Figure 5:
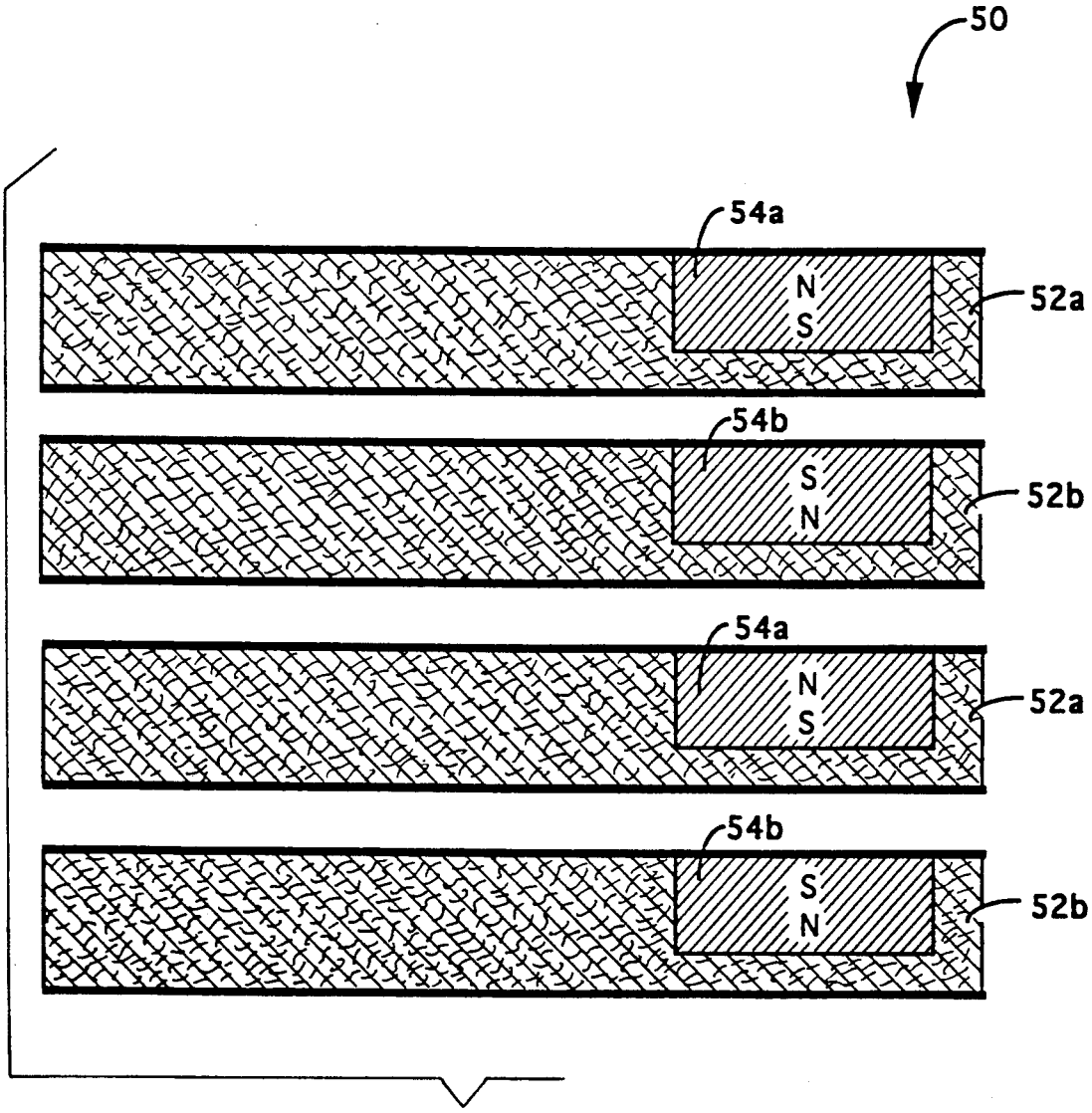
FIG. 5 is a cross-sectional view of magnetic spacers embedded into the sheets with alternating sets of repulsive like poles.

FIG. 5 illustrates another alternative embodiment 50 of the invention, consisting of a sequence of leaves 52*a* and 52*b* which have magnets 54*a* and 54*b* embedded in each of them. Leaves 52*a* have embedded in them a magnet 54*a* whose north pole faces upward, while leaves 52*b* have embedded in them a magnet 54*b* whose south pole faces upward, at the same position as on leaves 52*a*. Leaves of type 52*a* and 52*b* are interleaved, so like magnetic poles face one another on successive pages, which provides the magnetic repulsion to maintain the desired page clearance.

The present invention in its several embodiments just described has two distinct advantages over prior art devices. First, it provides clearance between leaves to allow young children to reach between, grasp and turn individual pages of a stiff-paged board book. This clearance facilitates page-turning irrespective of where the reader grasps the page, in contrast to previous approaches which are effective only if the reader grasps a special section of the page. Secondly, the present invention reduces the tendency of pages to stick to one another, because the contact area between successive leaves is reduced substantially.

This invention contemplates that a variety of methods can be used to form a spacer which is an integral part of the page and that a variety of materials can be used to create a spacer and affix it to the page if it is not an integral part of the page. This variety will nonetheless accomplish the equivalent result of maintaining a separation between consecutive pages to facilitate page-turning. While the invention has been described with reference to the preferred embodiment thereof, it will be appreciated by those of ordinary skill in the art that modifications can be made to the structure and elements of the invention without departing from the spirit and scope of the invention as a whole.

I claim:

1. A board book comprising:

a plurality of stiff pages, each of said pages having a first and a second relatively flat surface on opposite sides thereof, and peripheral edge which at least partially surrounds said first and second relatively flat surfaces; and, at least one spacer means coupled to at least one first relatively flat surface, said spacer means located substantially completely inside of said peripheral edge, wherein said spacer means produces a gap between adjacent pages that runs substantially the length of said peripheral edge of said page in order to facilitate the turning of said page from any point along said peripheral edge.

2. The board book of claim 1 further including:

a binder for binding said plurality of stiff pages together, wherein said spacer means is positioned substantially near the center of the peripheral edge of said page opposite said binder.

3. The board book of claim 1 wherein at least one of said pages has spacer means on said first and second relatively flat surfaces of the same page.

4. The board book of claim 1 wherein said spacer means has a thickness between about 0.03 inch and 0.20 inch.

5. The board book of claim 4 wherein said spacer means is permanently attached to said page.

6. The board book of claim 5 wherein said spacer means is solid.

7. The board book of claim 6 wherein said spacer means is formed from a material selected from the group consisting of cardboard and plastic.

8. The board book of claim 1 wherein said spacer means is a protrusion that is integral with said page.

9. The board book of claim 7 further comprising second spacer means.

10. A book which comprises:

a plurality of pages, each of said pages having a first and a second relatively flat surface on opposite sides thereof and a peripheral edge which at least partially surrounds said first and second relatively flat surfaces;

a first magnetic spacer means imbedded in a first page; and, a second magnetic spacer means imbedded in a second page, wherein said first magnetic spacer means is located adjacent to said second magnetic spacer means, and said first and second magnetic spacer means are oriented so that facing magnetic poles are the same for providing magnetic repulsion between adjacent pages.

* * * * *